US010436423B2

(12) United States Patent
Meyer

(10) Patent No.: US 10,436,423 B2
(45) Date of Patent: Oct. 8, 2019

(54) INSERT AND LED HOLDER ASSEMBLY USING SAME

(71) Applicant: MOLEX INCORPORATED, Lisle, IL (US)

(72) Inventor: Gregory P. Meyer, Elk Grove Village, IL (US)

(73) Assignee: Molex, LLC, Lisle, IL (US)

( * ) Notice: Subject to any disclaimer, the term of this patent is extended or adjusted under 35 U.S.C. 154(b) by 302 days.

(21) Appl. No.: 15/035,493

(22) PCT Filed: Jan. 12, 2015

(86) PCT No.: PCT/US2015/011007

§ 371 (c)(1),
(2) Date: May 10, 2016

(87) PCT Pub. No.: WO2015/106192

PCT Pub. Date: Jul. 16, 2015

(65) Prior Publication Data

US 2016/0281966 A1 Sep. 29, 2016

Related U.S. Application Data

(60) Provisional application No. 61/926,015, filed on Jan. 10, 2014.

(51) Int. Cl.
*F21V 19/00* (2006.01)
*F21V 3/06* (2018.01)
(Continued)

(52) U.S. Cl.
CPC ..... *F21V 19/004* (2013.01); *F21V 19/0025* (2013.01); *F21V 23/06* (2013.01);
(Continued)

(58) Field of Classification Search
CPC ..... F21V 27/02; F21V 23/06; F21V 19/0025–19/0055; H01R 12/721; H01R 13/405–13/415
See application file for complete search history.

(56) References Cited

U.S. PATENT DOCUMENTS 4,598,346 A * 7/1986 Bodde ..... A01K 75/02 362/255
6,982,873 B2 1/2006 Meyer et al.
(Continued)

FOREIGN PATENT DOCUMENTS

CN 201421900 Y 3/2010
CN 102361182 A 2/2012
(Continued)

OTHER PUBLICATIONS

International Search Report and Written Opinion received for PCT application No. PCT/US2015/011007, dated Apr. 23, 2015, 13 pages.

(Continued)

*Primary Examiner* — Anh T Mai
*Assistant Examiner* — Steven Y Horikoshi
(74) *Attorney, Agent, or Firm* — Molex, LLC

(57) ABSTRACT

A holder includes a socket. An insert can be positioned in the socket and includes two terminals configured to engage pads on an LED array. The insert and holder configuration can be configured to provide electrical isolation for a COB LED array so that additional flexibility in the selection of power suppliers is possible.

11 Claims, 21 Drawing Sheets

(51) Int. Cl.

| | |
|---|---|
| ***F21V 27/02*** | (2006.01) |
| ***F21V 23/06*** | (2006.01) |
| ***H01R 13/405*** | (2006.01) |
| ***F21V 29/70*** | (2015.01) |
| ***H01R 33/74*** | (2006.01) |
| *H01R 33/18* | (2006.01) |
| *F21Y 105/10* | (2016.01) |
| *F21Y 115/10* | (2016.01) |
| *F21Y 101/00* | (2016.01) |

(52) U.S. Cl.

CPC ..... *F21V 27/02* (2013.01); *F21V 29/70* (2015.01); *H01R 13/405* (2013.01); *H01R 33/74* (2013.01); *F21Y 2101/00* (2013.01); *F21Y 2105/10* (2016.08); *F21Y 2115/10* (2016.08); *H01R 33/18* (2013.01)

(56) References Cited

U.S. PATENT DOCUMENTS

| | | | | |
|---|---|---|---|---|
| 7,442,057 | B2 | 10/2008 | Ko | |
| 7,618,297 | B2 | 11/2009 | Wang | |
| 7,686,659 | B2 | 3/2010 | Peng | |
| 8,342,727 | B2 | 1/2013 | Owen, Sr. et al. | |
| 8,348,478 | B2 | 1/2013 | Pelton et al. | |
| 8,506,333 | B2 | 8/2013 | Wang et al. | |
| 9,431,764 | B2 | 8/2016 | Ho | |
| 9,587,816 | B2 | 3/2017 | Peters et al. | |
| 2005/0180157 | A1* | 8/2005 | Watanabe | F21V 19/004 362/543 |
| 2007/0167047 | A1* | 7/2007 | Ohashi | B29C 45/0025 439/164 |
| 2010/0072505 | A1* | 3/2010 | Gingrich, III | F21K 9/00 257/99 |
| 2011/0103081 | A1* | 5/2011 | Thullier | F21S 48/1109 362/396 |
| 2011/0136394 | A1* | 6/2011 | Mostoller | F21K 9/00 439/701 |
| 2011/0140136 | A1* | 6/2011 | Daily | H01R 12/721 257/89 |
| 2011/0211351 | A1* | 9/2011 | Van De Ven | F21K 9/238 362/249.02 |
| 2013/0084748 | A1 | 4/2013 | Zaderej et al. | |
| 2013/0107550 | A1* | 5/2013 | Urano | H01R 12/721 362/382 |
| 2013/0176732 | A1 | 7/2013 | McGowan et al. | |
| 2013/0334953 | A1 | 12/2013 | Keser et al. | |
| 2014/0063814 | A1 | 3/2014 | McGowan et al. | |

FOREIGN PATENT DOCUMENTS

| | | | |
|---|---|---|---|
| CN | 102403634 | A | 4/2012 |
| CN | 202395193 | U | 8/2012 |
| CN | 202797365 | U | 3/2013 |
| CN | 202817390 | U | 3/2013 |
| CN | 203242791 | U | 10/2013 |
| JP | 2012-243462 | A | 12/2012 |
| JP | 2013-093192 | A | 5/2013 |
| WO | 2015/095174 | A1 | 6/2015 |

OTHER PUBLICATIONS

International Preliminary Report on Patentability received for PCT Application No. PCT/US2015/011007, dated Jul. 21, 2016, 11 pages.

Extended European Search Report received for European Application No. 15735555.3, dated May 12, 2017, 7 pages.

* cited by examiner

INSERT AND LED HOLDER ASSEMBLY USING SAME

RELATED APPLICATIONS

This application is a National Phase application of PCT/US2015/011007 filed on Jan. 12, 2015 and claims priority to U.S. Provisional Application No. 61/926,015, filed Jan. 10, 2014, both of which are incorporated herein by reference in their entirety.

TECHNICAL FIELD

This disclosure relates to field of solid state lighting, more specifically to applications that use arrays of light emitting diodes.

DESCRIPTION OF RELATED ART

The use of a light emitting diode (LED) to provide general illumination is well known. One significant issue with LED designs is that, compared to incandescent lights, there is a great deal more flexibility in how LEDs can be used. This remarkable capability and flexibility has made it difficult for one design to emerge as clearly superior to other designs. LEDs exist in a variety of form factors such as emitters and chip-on-board (COB). Each of these form factors can be used in similar and different applications but generally require different methods to secure them into position. As LEDs have become more efficient the necessary size of an LED package (for a given lumen output) has shrunken, which has further complicated the issue of using LEDs.

For example, LED holders are used to secure LED arrays provided as a COB form factor but the shape and size of the LED array can vary substantially, as can the remainder of the system. This makes is difficult to provide a standard form factor for LEDs that a light fixture designer can plan for and has caused costs to increase. Even within certain more common sizes the requirements for a particular holder vary substantially. Some holders help solve one issue (such as packaging) but fail to address other issues such as ease of use or creepage and clearance issues. Consequentially, further improvements in the LED holder design would be appreciated by certain individuals.

SUMMARY

A holder is provided with an array recess and a socket. An insert is positioned in the socket and is configured to mate with a light emitting diode (LED) array positioned in the array recess. The insert can be mated to a holder so as to provide a holder assembly that helps secure the LED array in position while providing electrical connection to the LED array. The holder, in combination with the insert, can be configured to address a variety of issues. In one example, the insert can include a mating pocket that accepts another connector. In other example, the insert can include wires that are coupled to contacts and allows for a premade connection between the wires and a corresponding LED array. The insert can include two projections that are positioned on two sides of a retention feature and the projections can help the holder assembly to meet creepage/clearance requirements.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
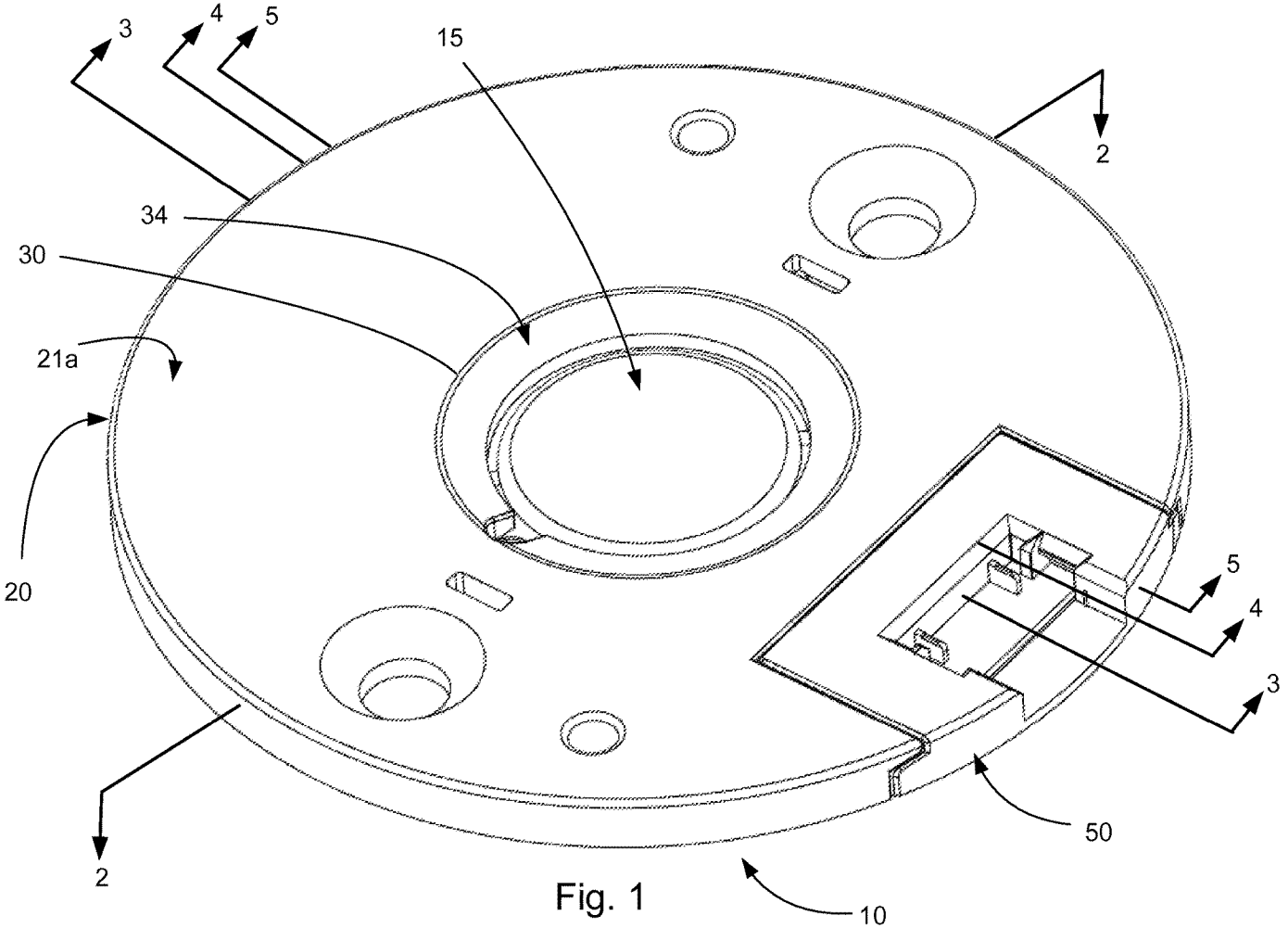
FIG. 1 illustrates a perspective view of an embodiment of an LED holder assembly.
Figure 2:
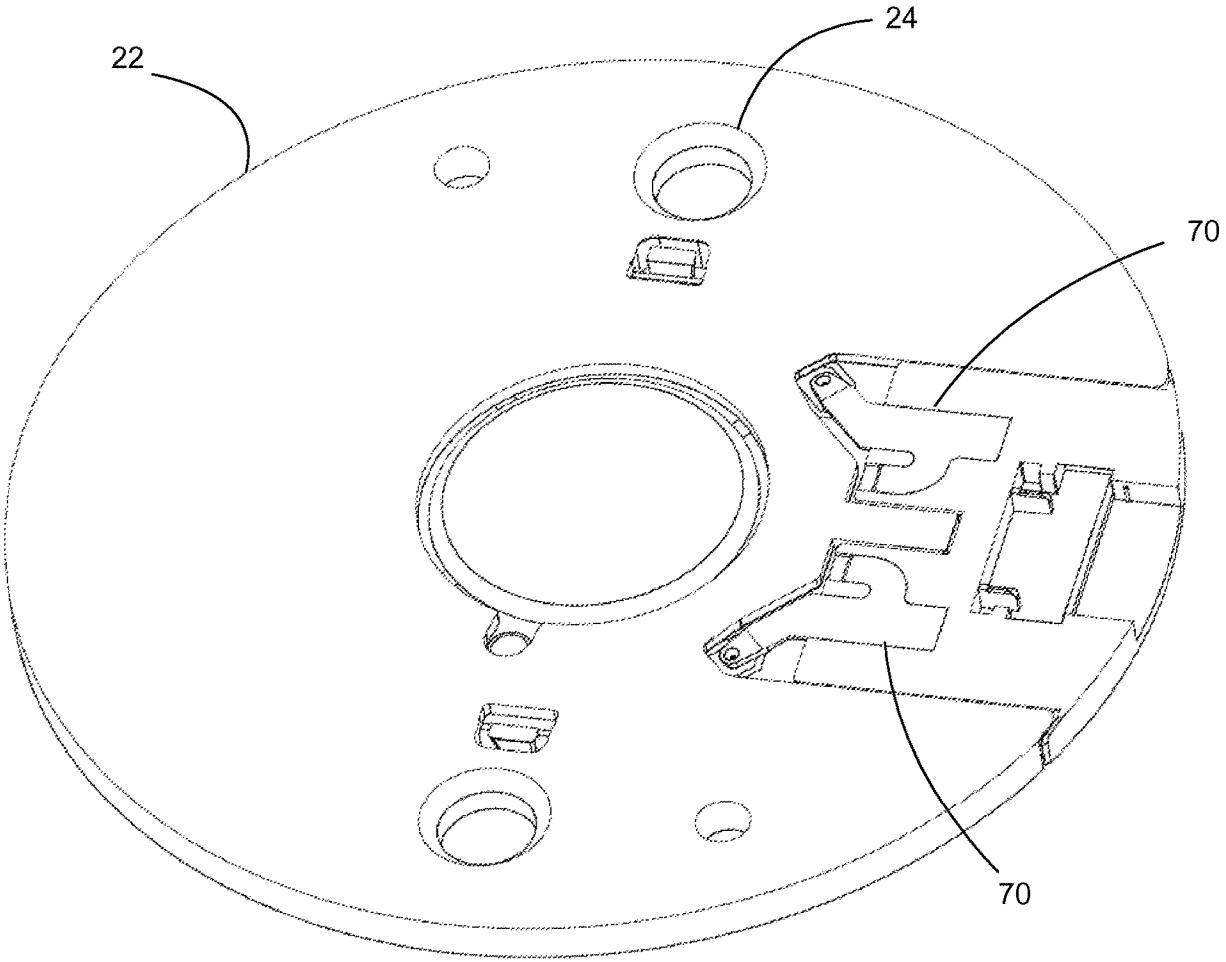
FIG. 2 illustrates a perspective view of a cross section of the embodiment depicted in FIG. 1 taken along line 2-2 in FIG. 1.
Figure 3:
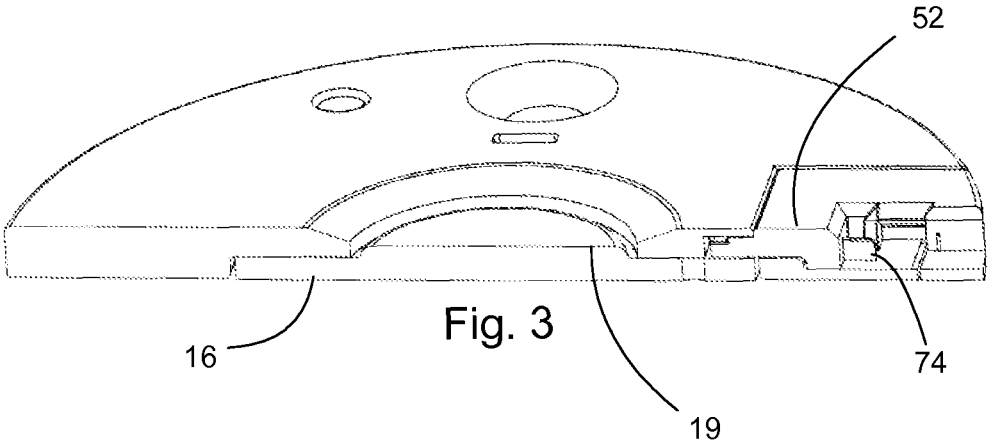
FIG. 3 illustrates a perspective view of a cross-section of the embodiment depicted in FIG. 1, taken along line 3-3 in FIG. 1.
Figure 4:
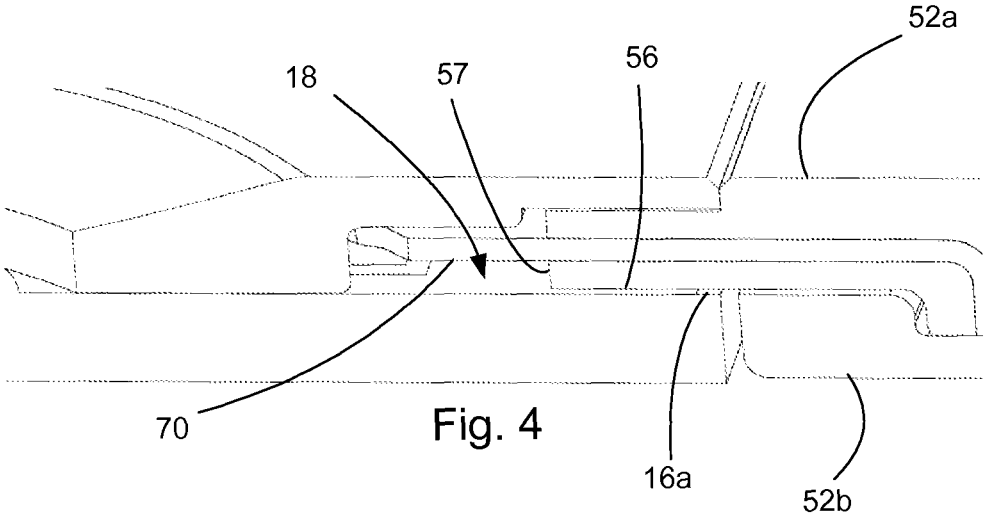
FIG. 4 illustrates a perspective view of a cross-section of the embodiment depicted in FIG. 1, taken along line 4-4 in FIG. 1.
Figure 5:
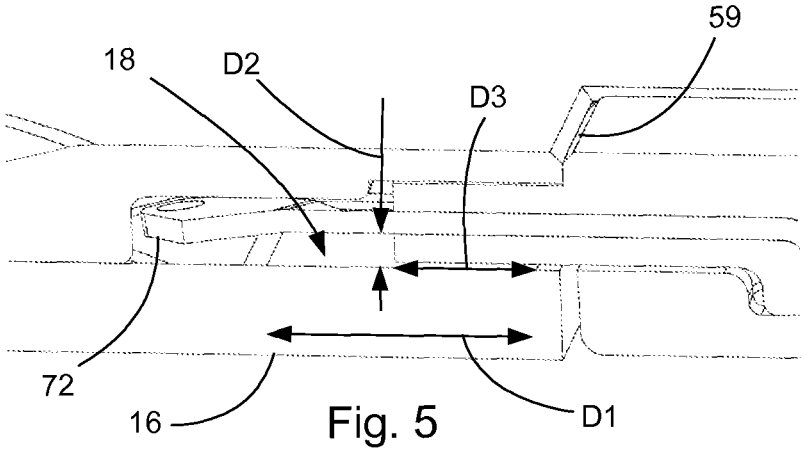
FIG. 5 illustrates a perspective view of a cross-section of the embodiment depicted in FIG. 1, taken along line 5-5 in FIG. 1.
Figure 6:
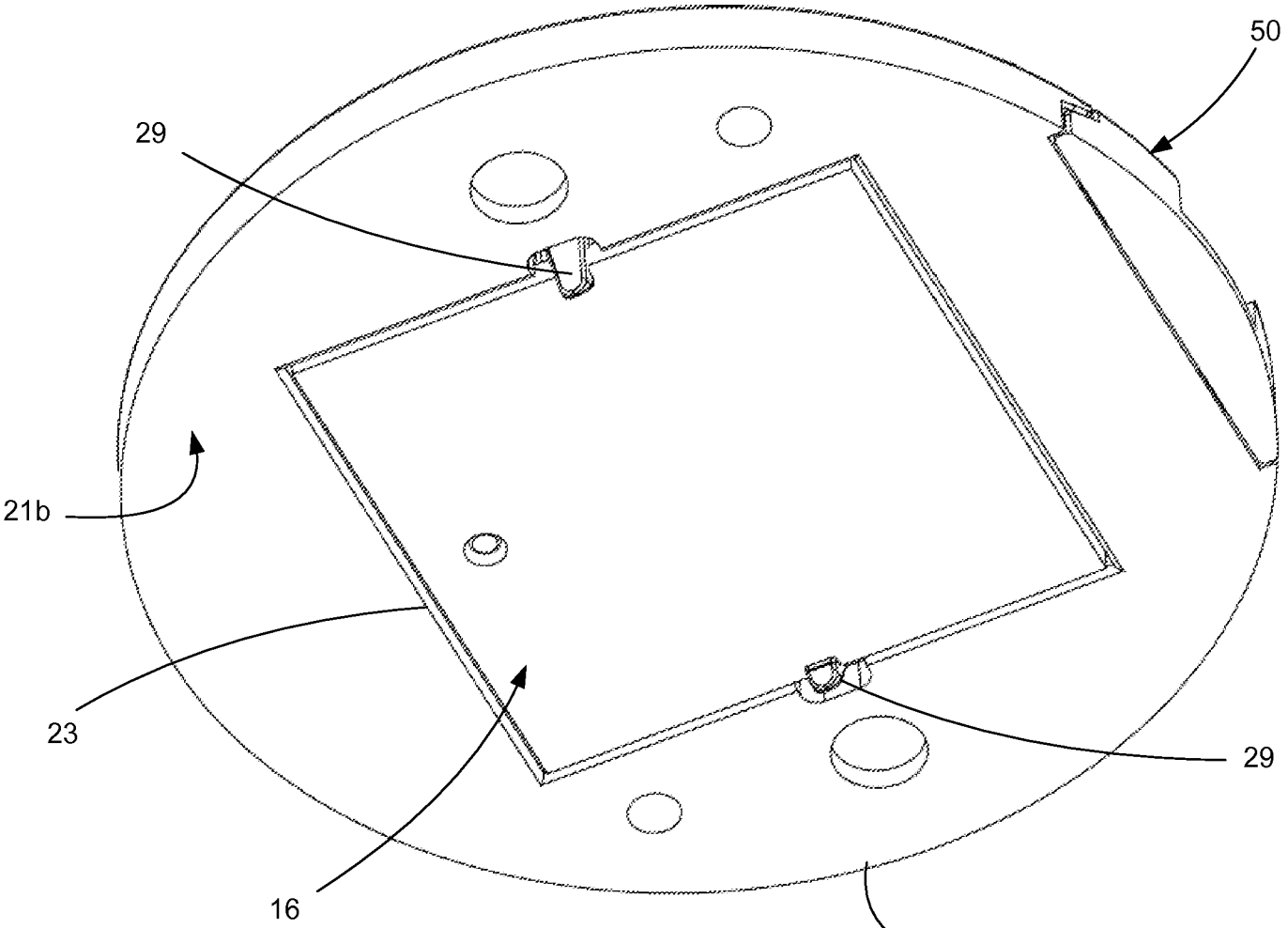
FIG. 6 illustrates another perspective view of an embodiment depicted in FIG. 1.
Figure 7:
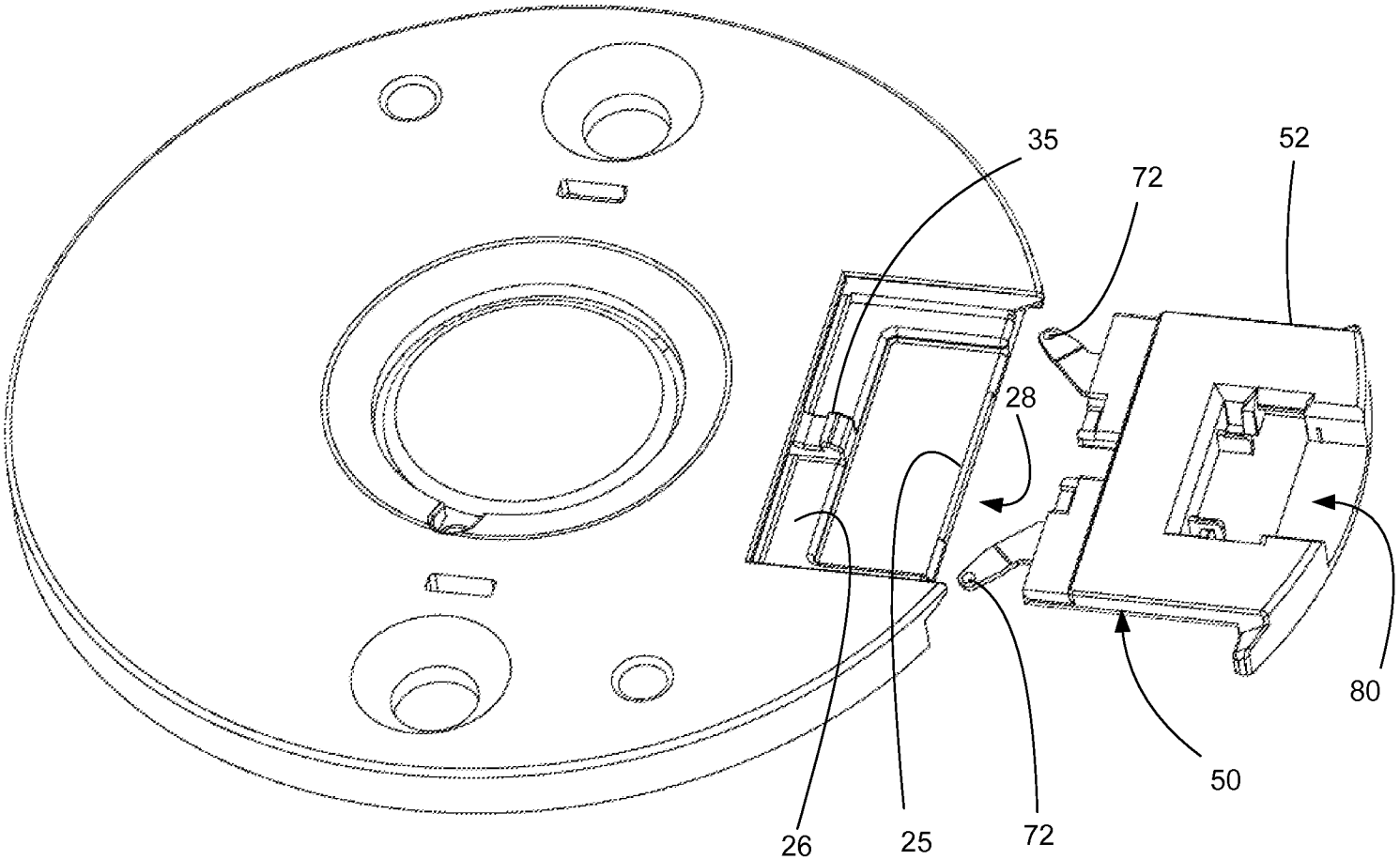
FIG. 7 inns rates a partially exploded perspective view of the embodiment depicted in FIG. 1.
Figure 8:
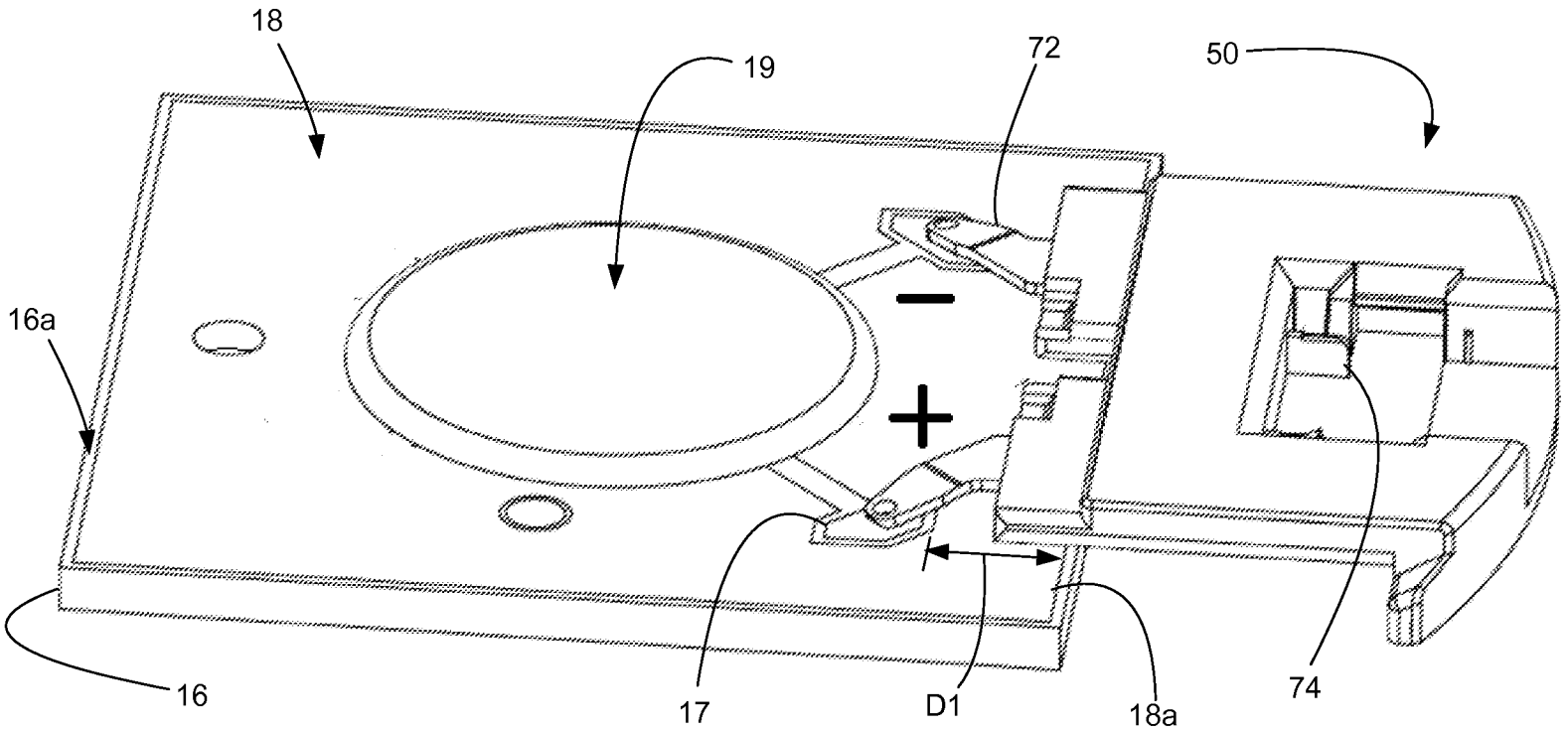
FIG. 8 a perspective view of an embodiment of an insert engaging an LED array.
Figure 9:
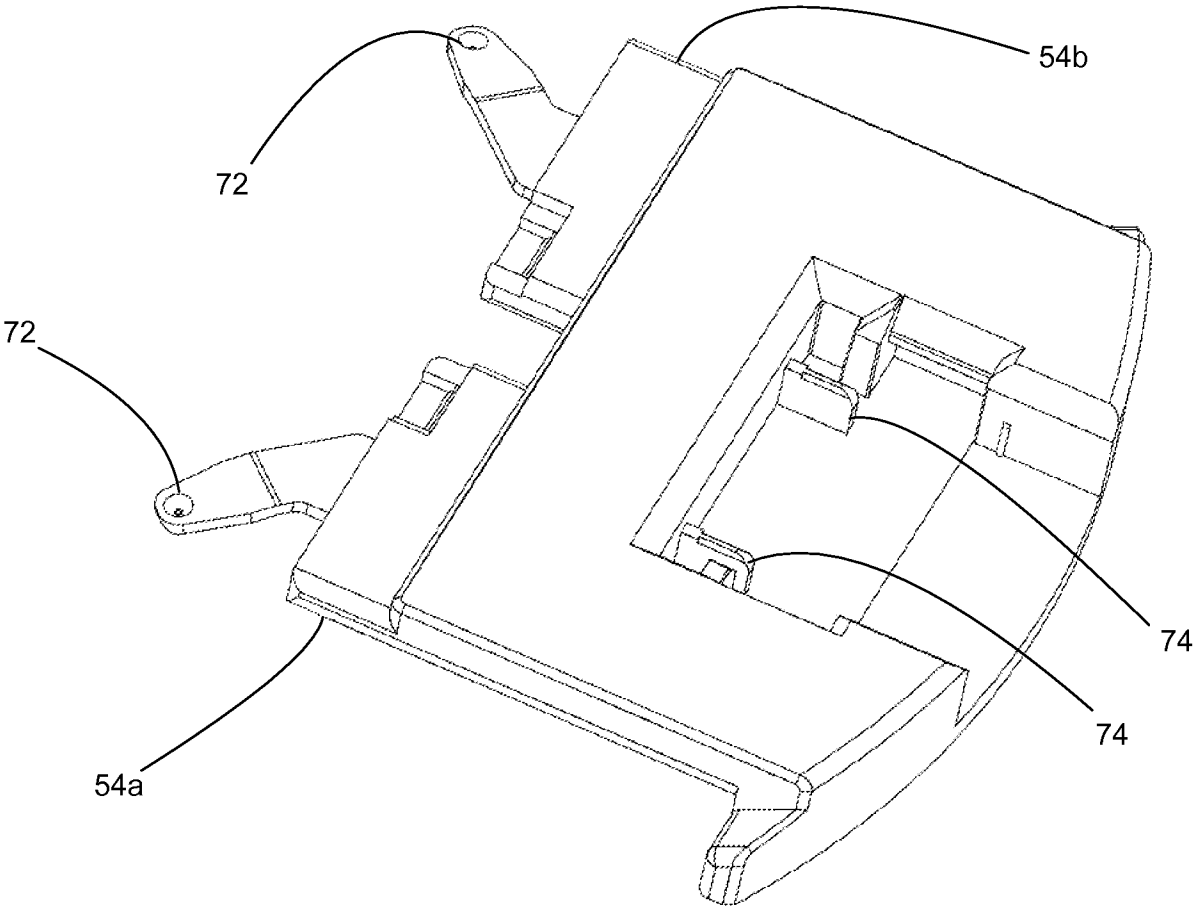
FIG. 9 illustrates a perspective view of an embodiment of an insert.
Figure 10:
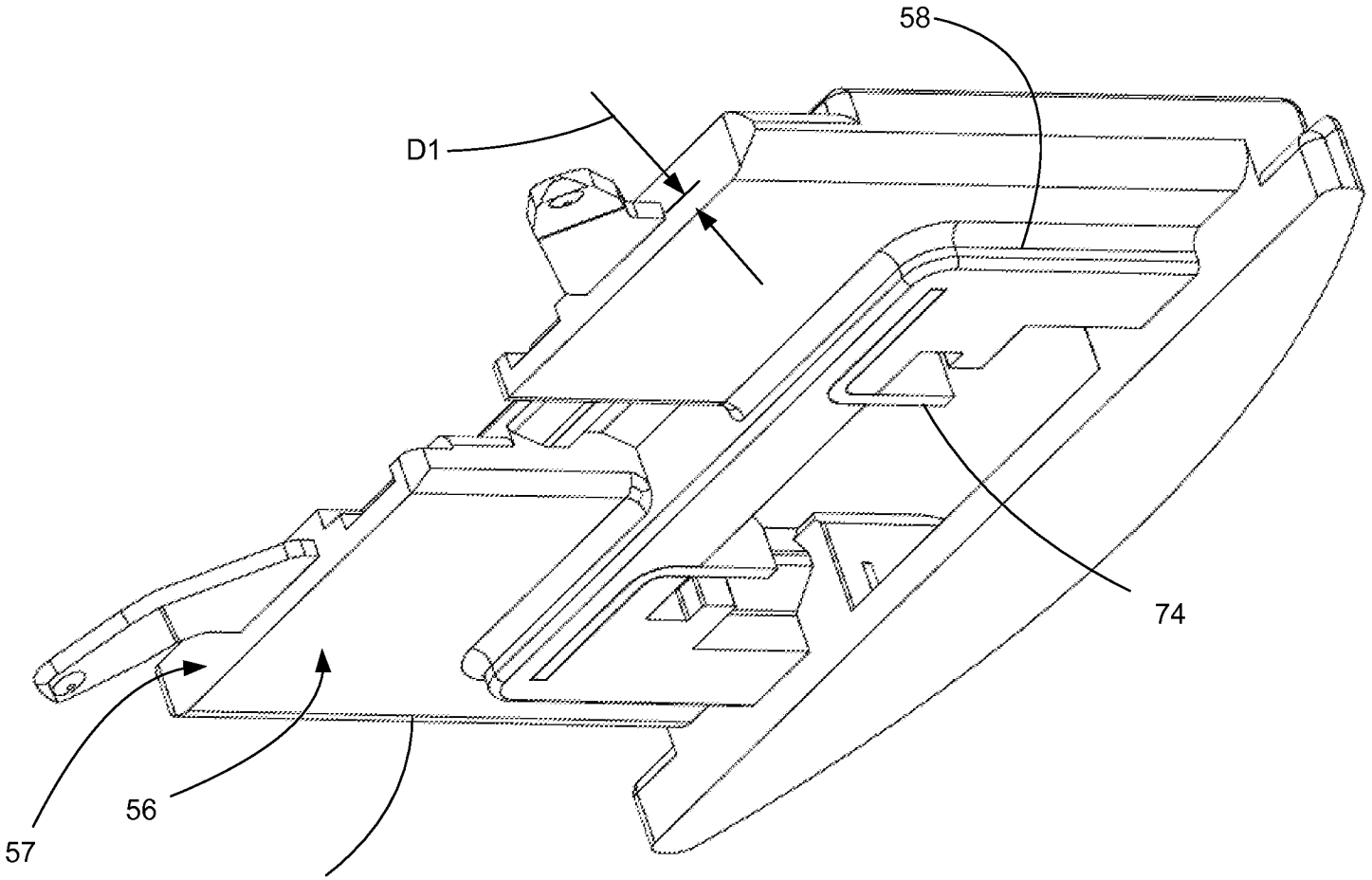
FIG. 10 illustrates another perspective view of the insert depicted in FIG. 9.
Figure 11:
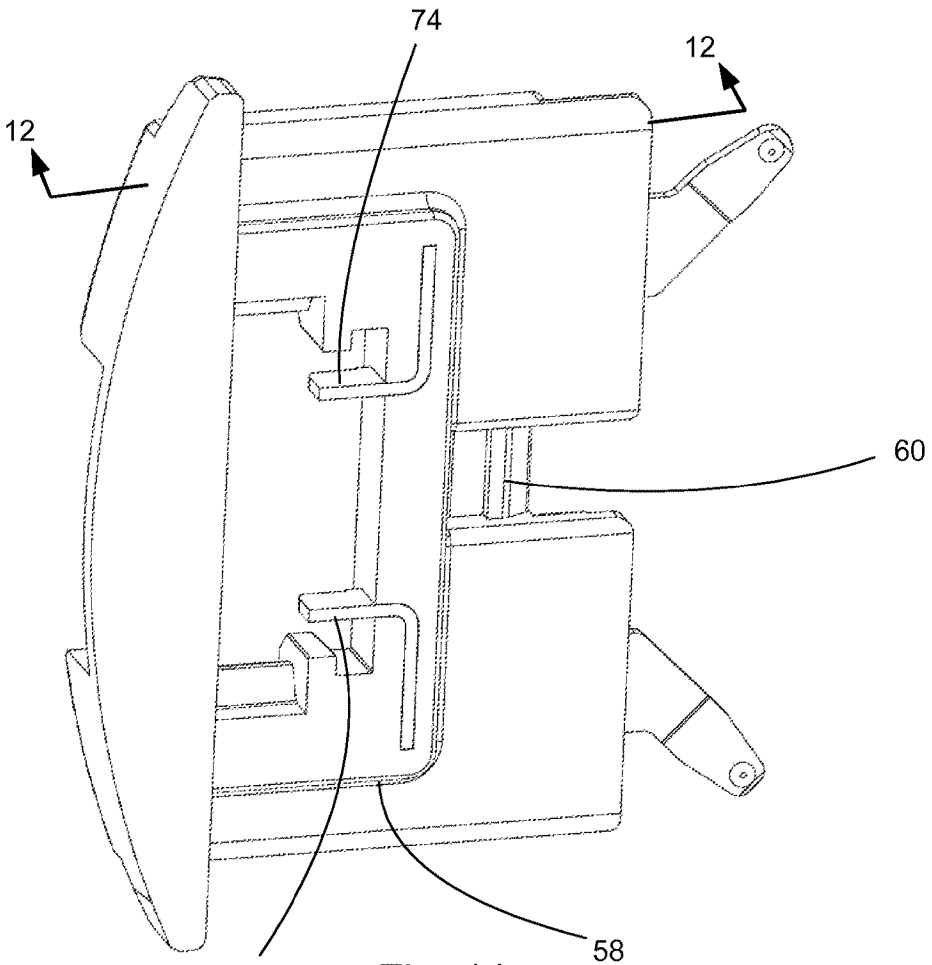
FIG. 11 illustrates another perspective view of the insert depicted in FIG. 9.
Figure 12:
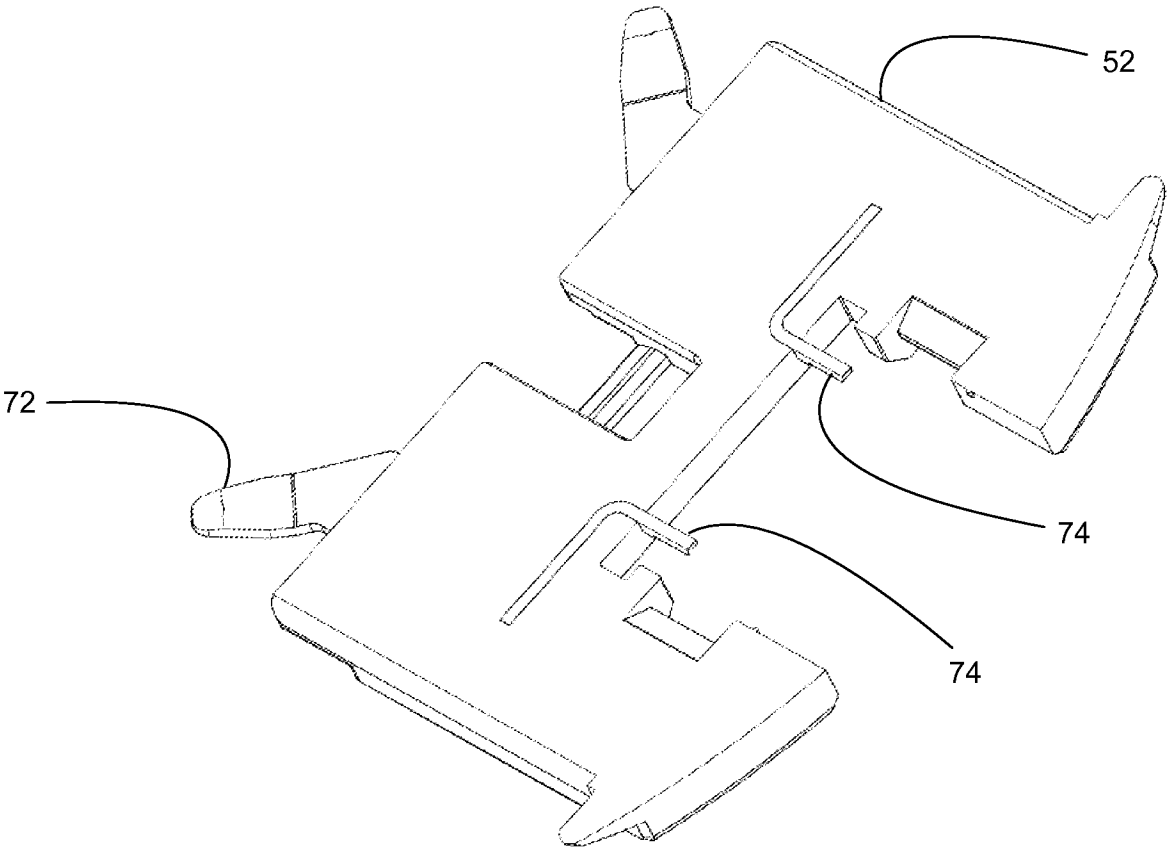
FIG. 12 illustrates a perspective view of a cross-section of the insert taken along line 12-12 in FIG. 11.
Figure 13:
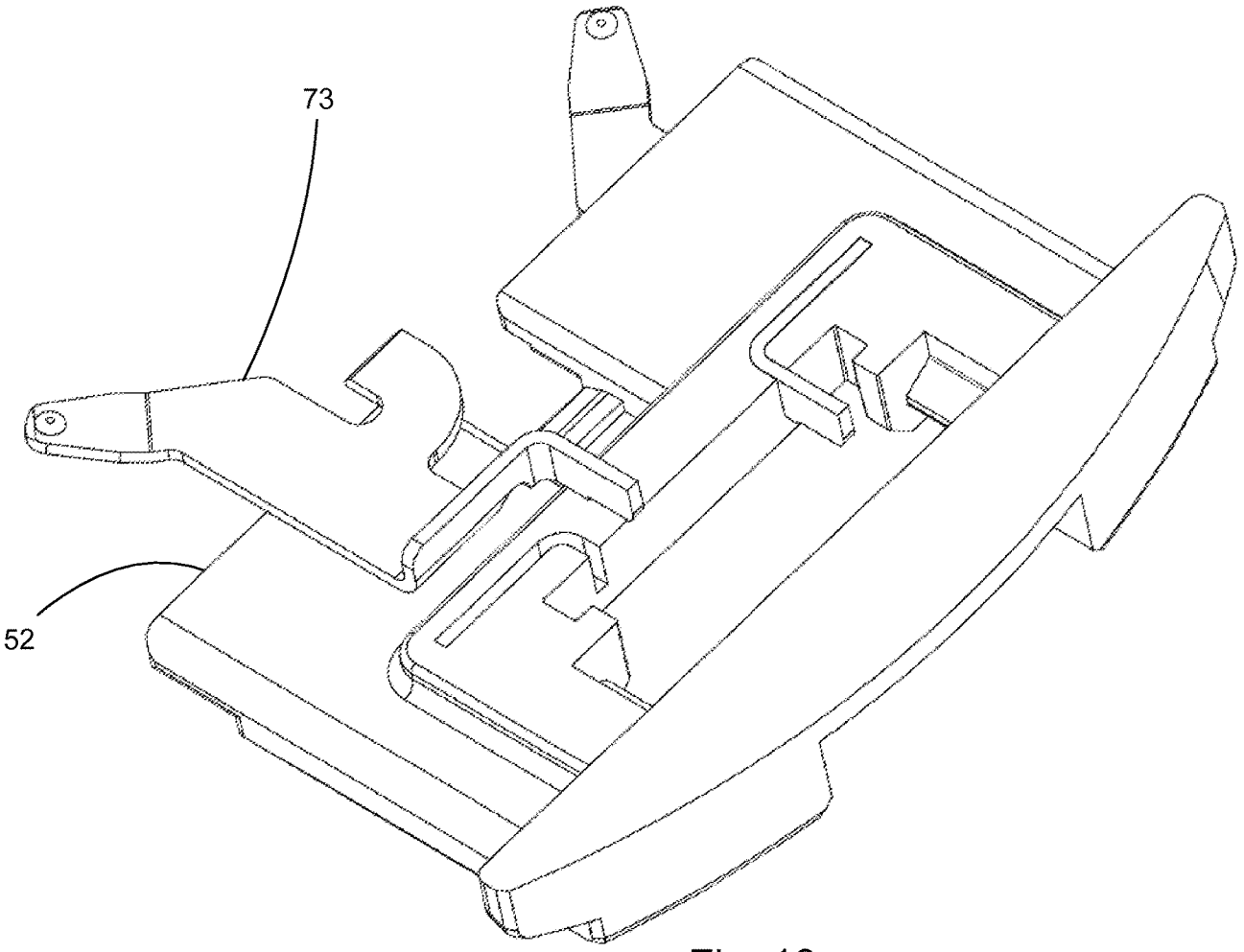
FIG. 13 illustrates a perspective partially exploded view of the insert depicted in FIG. 9.
Figure 14:
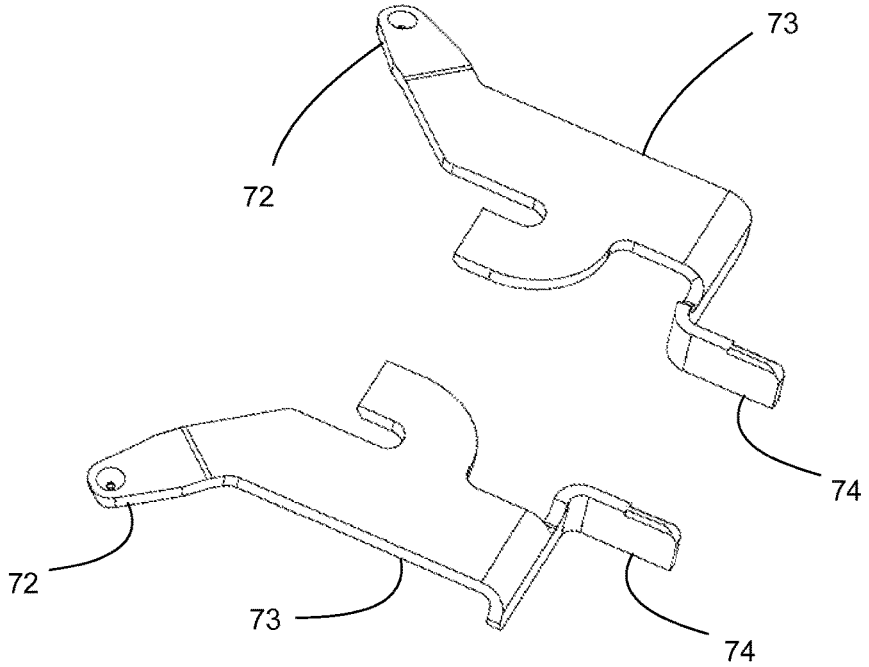
FIG. 14 illustrates a perspective view of an embodiment of a pair of terminals.
Figure 15:
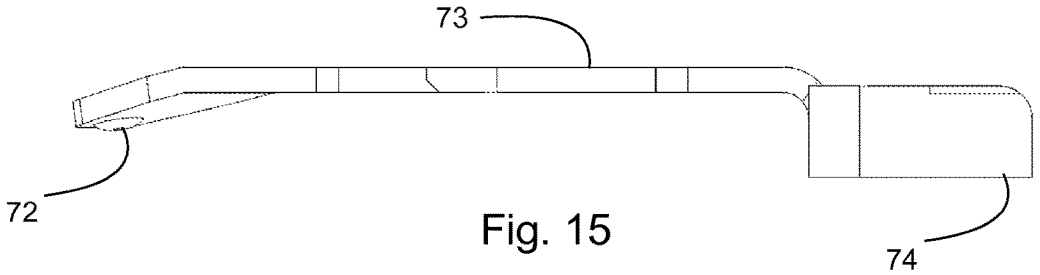
FIG. 15 illustrates an elevated side view of an embodiment of a terminal.
Figure 16:
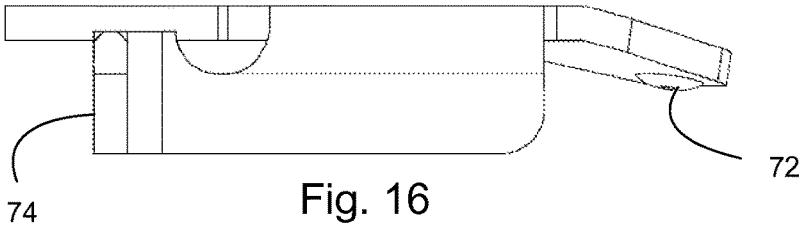
FIG. 16 illustrates an elevated front view of an embodiment of a terminal.

FIGS. 1-16 illustrate features that can be included in a first embodiment of a light emitting diode (LED) holder assembly. It should be noted that while the depicted assembly has a holder that is circular in shape, any desirable shape such as rectangular, square, triangular, oval or other suitable shape could be provided. The holder provides a mechanical structure for securing an LED array into position without undesirably interfering with the light emitted from the LEDs provided on the LED array (when in operation). Thus, additional features can be added to the holder, without limitation, such as a lens or reflector. In addition, features can be added to the holder to provide mounting points for other components. Thus, the general design of the holder, unless otherwise noted, is not intended to be limiting. As can be further appreciated, the holder, while depicted as having a very low profile (which is suitable for applications where other features of a corresponding light fixture are going to provide light shaping functionality) can also include many other features, which can be integral or mounted onto the holder, and can be made much thicker.

The depicted LED holder assembly 10 includes a holder 20. The holder 20 includes a top side 21*a* and a bottom side 21*b*. The holder 20 has a frame 22 that may optionally include fastener holes 24 for mounting the holder 20 in position. The frame 22 includes a socket 28 that is configured to receive an insert 50. The insert 50, when inserted into the socket 28, forms a connection joint 59 with the frame 22 on the top side 21*a*. In operation, the insert 50 can be positioned in the socket 28 and then an LED array 15 with contact pads 17 on an insulative surface 18 can be positioned in an array recess 23 of the holder 20. A light aperture 30, which may include a tapered surface 34, is provided in the holder so that light emitted from the LED array 15 can pass through the holder 20.

As noted above, the socket 28 that is configured to receive the insert 50. The insert 50 includes two terminals 70 that are configured to engage pads on a surface of an LED array. Thus, the holder 20 does not need to include any terminals but instead can be formed entirely of an insulative material. This allows for ease of manufacturing (as there is no need to worry about insert molding terminals into the housing, for example) and because of the lack of a need to support terminals, may allow for additional types of resins and also makes the cover well suited to provide more decorative finishes, if desired. In addition, as noted above, the holder can be any desirable shape and the ability to omit terminals provides for additional flexibility in the shape of the holder.

The terminals 70 can make electrical connection with the contact pads 17 and provide power to the chip array 19, which comprises is a plurality of LED chips that are covered in a protective coating and which may also include a phosphor layer to help convert the emitted light (which may be a narrow range of blue or potentially even UV light) into a more desirable range of wavelengths, it is common for an LED array 15 to have a substrate 16 made of a conductive material such as an aluminum alloy (for thermal energy transfer purposes) and the insulative surface 18 is formed by placing a coating on the base. However, the LED construction could have any number of variations. It can be appreciated that the contact pads 17 are positioned on a substrate 16 and are positioned a distance from an edge 18*a* of the insulative surface 18. In other words, a conductive surface 16*a* of the substrate 16 will be a distance D1 from the contact pad 17 and in an embodiment (as depicted) the conductive surface 16*a* will be on the same side as the contact pad 17. This distance D1 can be readily configured to ensure sufficient creepage distance so at to allow the LED array to be used in systems that require a particular air gap between conductive areas.

One issue that has been determined to exist with a low profile system that is going to make electrical connection with the contact pads 17 of the LED array 15 is that unless the terminals come straight down (which would substantially increase the height of the system) the terminals will extend from the edge of the substrate 16 and thus pass much closer to the conductive surface 16*a* and the contact and may therefore make it more difficult to provide the necessary creepage/clearance distance. This is particularly true if the terminal is intended to flex when engaging the contact pad 17 as such a design will require that the terminal have some cantilevered portion that allows the terminal contact to deflect when it engages the contact 17.

The insert 50 includes terminals 70 that are configured to make electrical connection with the contact pad 17. The terminal 70 includes a first contact 72 that makes contact with the contact pad 17 on the LED array 15 and includes a second contact 74 that is positioned in the pocket 80. A body 73 connects the first and second contacts and is supported by a base 52 of the insert 50. As can be appreciated, the base 52 includes two projections 54*a*, 54*b*. A shoulder 58 can be provided on bottom side of the insert and the shoulder 58 helps encapsulate the terminal 70 so as to provide electrical isolation.

As can be appreciate from the cross-sections of the LED holder assembly 10, the projections 54*a*, 54*b* are configured to extend past the conductive surface 16*a*. The projections include faces 56 and 57. The distance along face 57 from the terminal 70 to the edge of projection 54*a* is a second distance D2 and the distance from that edge to the conductive surface 16*a* is a third distance D3. In general the distance D2 plus the distance D3 will be configured to provide a total distance that provides an acceptable creepage but generally will be less than distance D1.

The depicted socket 28 provides electrical isolation between a mated insert and the support surface provided below the holder. The socket 28 includes a shelf 25 (which can be appreciated from FIG. 7) and a ledge 26 that rests on the shelf 25 and the ledge 25 is configured to extend over the top surface of the LED array. The base 52 and the projections 54*a*, 54*b* and the terminals 70 are supported by the ledge 26 and the first contacts 72 extend beyond the ledge 26 over the LED array 15. As depicted, the projections have a notch 60 between the two terminals 70 and the notch 60 provides a location for a retaining finger 35 in the socket 28 to engage and retain the insert 50 once it is inserted in the socket 28.

As noted above, the substrate 16 can be formed of an aluminum alloy and can be covered by an insulative material so that the area surrounding the pads is insulative. Therefore, as can be appreciated from FIGS. 3-5, to provide creepage and clearance the projections 54*a*, 54*b* are configured so that the distance from the terminal to the edge of the insulative material along the perimeter of the ledge provides the necessary distance for desirable electrical isolation. Preferably the distance along the perimeter will be at least 1.3 mm but some other distance such as 2.0 mm can also be provided, depending on desired voltage separation. It should be noted that the perimeter along both sides of the ledge (e.g., along a top and a bottom of the ledge) can be configured to provide the necessary distance needed to provide the desired creepage/clearance. Thus the distance from the terminal to the connection joint 59 can be equal to or greater than the sum of distances D2 and D3. In operation, therefore, the ledge provides for a holder that can be used with class 1 or class 2 power supplies due to the ability to provide desirable electrical isolation. This is particularly useful in a device that can be less than 2 mm high.

As can be appreciated, the holder can include features that help retain the LED array in the holder until it is mounted in position. For example, the depicted embodiment of the holder includes two arms 29 that extend below the bottom surface of the frame 22 and help retain the LED array in the array recess 23. Alternatively, the holder could be heat staked (a projection could engage an opening in the LED array) or adhered to the LED array 15 with other convention fastening techniques. It should be noted that in the depicted embodiment the holder 20 and LED array 15 do not need to be overly securely held together as it is intended for the holder to be mounted to a support surface (which may also act as a heat sink) and the mounting of the holder to the support surface (not shown) will ensure there is a good electrical connection between the terminals and the pads on the LED array and between the LED array and the support surface (so that there is desirable thermal performance).

As can be appreciated, the terminals 70 include the first contacts 72 are configured to extend into the array recess 23 to engage a pad (such as contact pad 17) and a terminal contact 74 that is configured to engage a mating terminal. The contact first 72 is configured to engage a pad aligned on a first plane and the terminal contact 74 is configured to engage a mating terminal from a mating connector. Because the insert 50 includes a mating pocket 80 that is configured to receive a mating connector that engages the mating pocket 80 by insertion in a direction that is substantially perpendicular to the first plane, the second contacts 74 have a rectangular shape. Such a construction allows for a very low profile holder assembly. If a low profile is not desired (which will depend on the holder application) then it is possible to use other terminal configurations. As can be appreciated from FIG. 16, the second contact 74 extends below the first contact.

Figure 17:
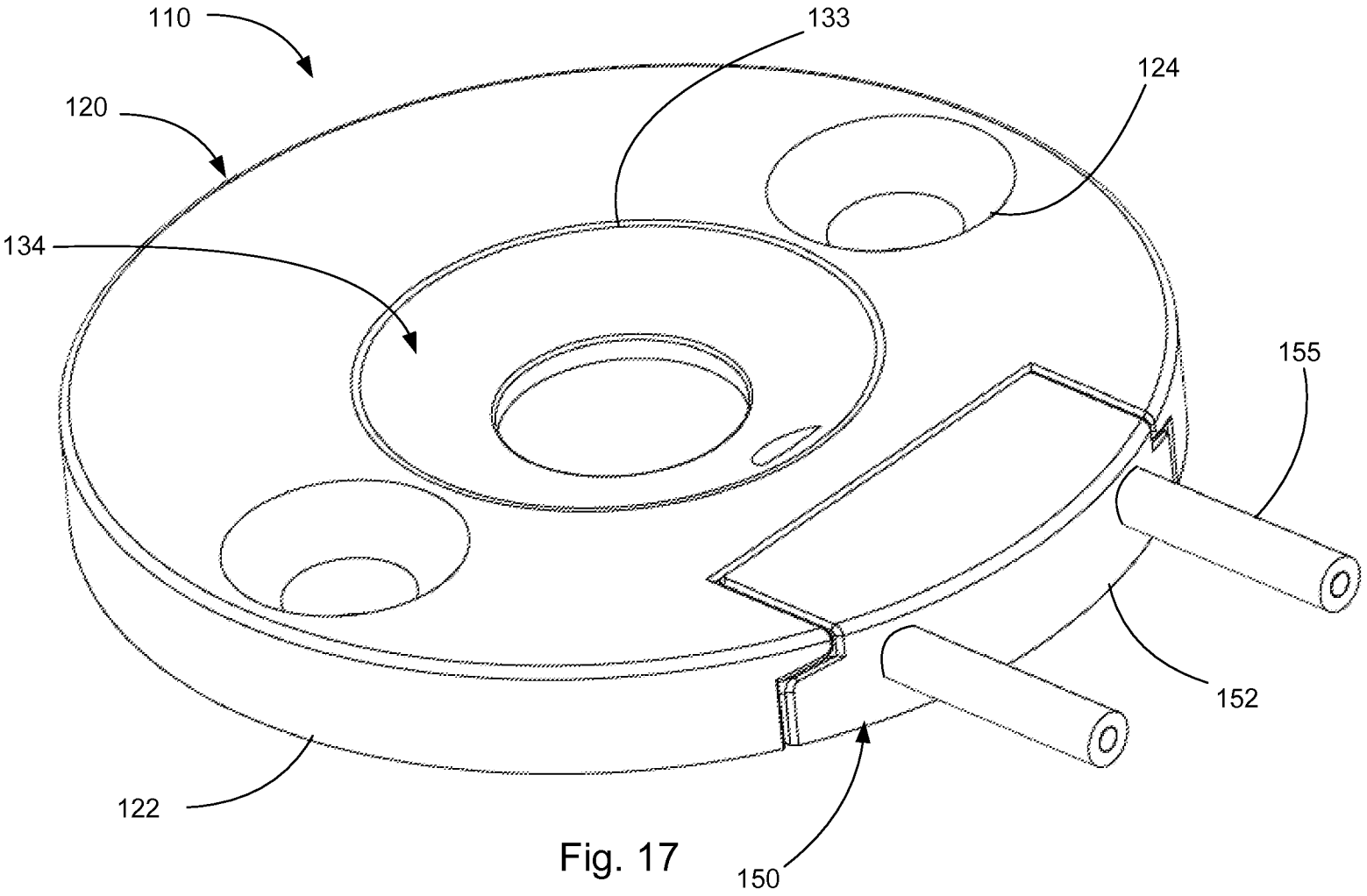
FIG. 17 illustrates a perspective view of an embodiment of a LED holder assembly.
Figure 18:
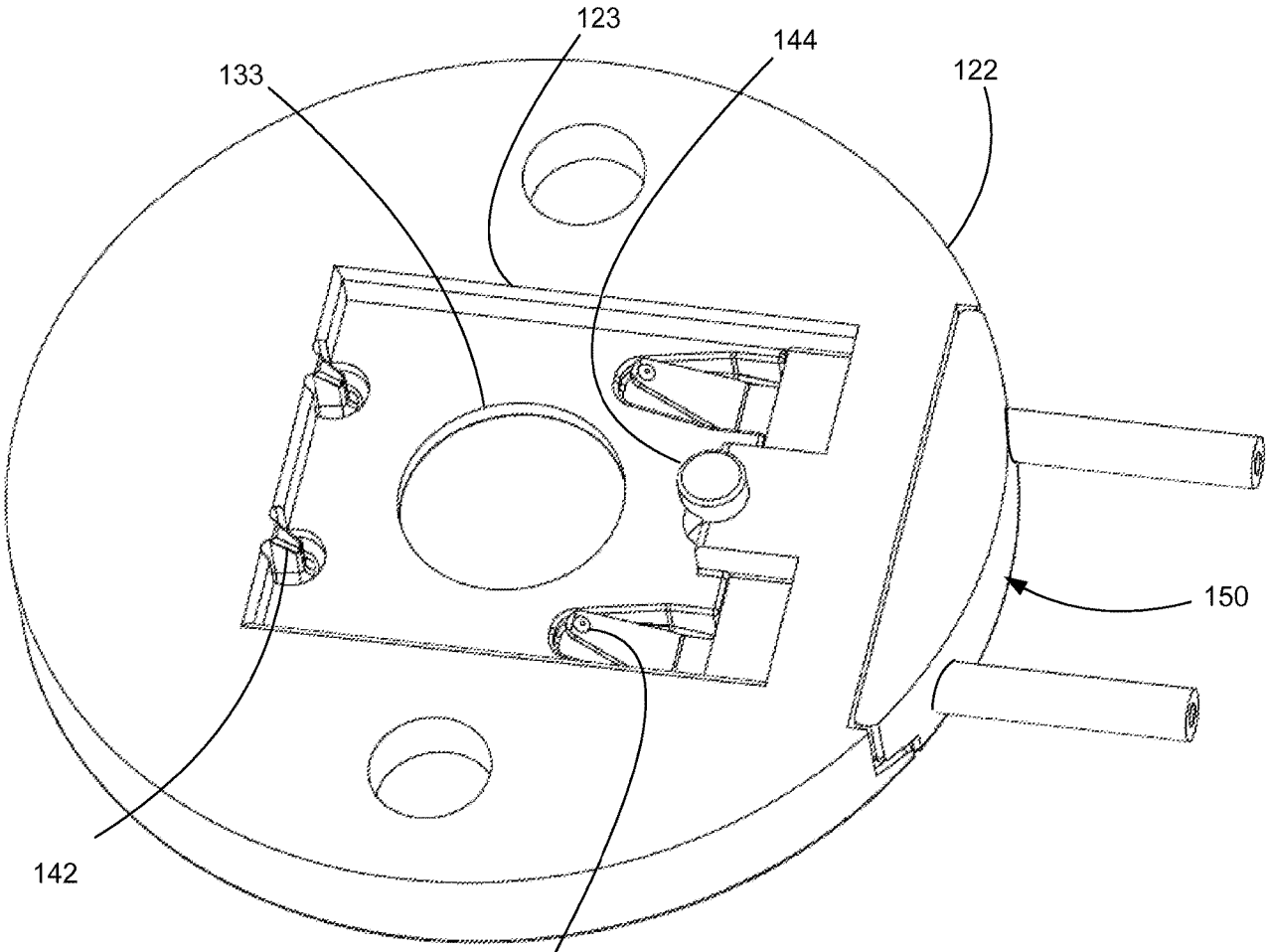
FIG. 18 illustrates another perspective view of the embodiment depicted in FIG. 17.
Figure 19:
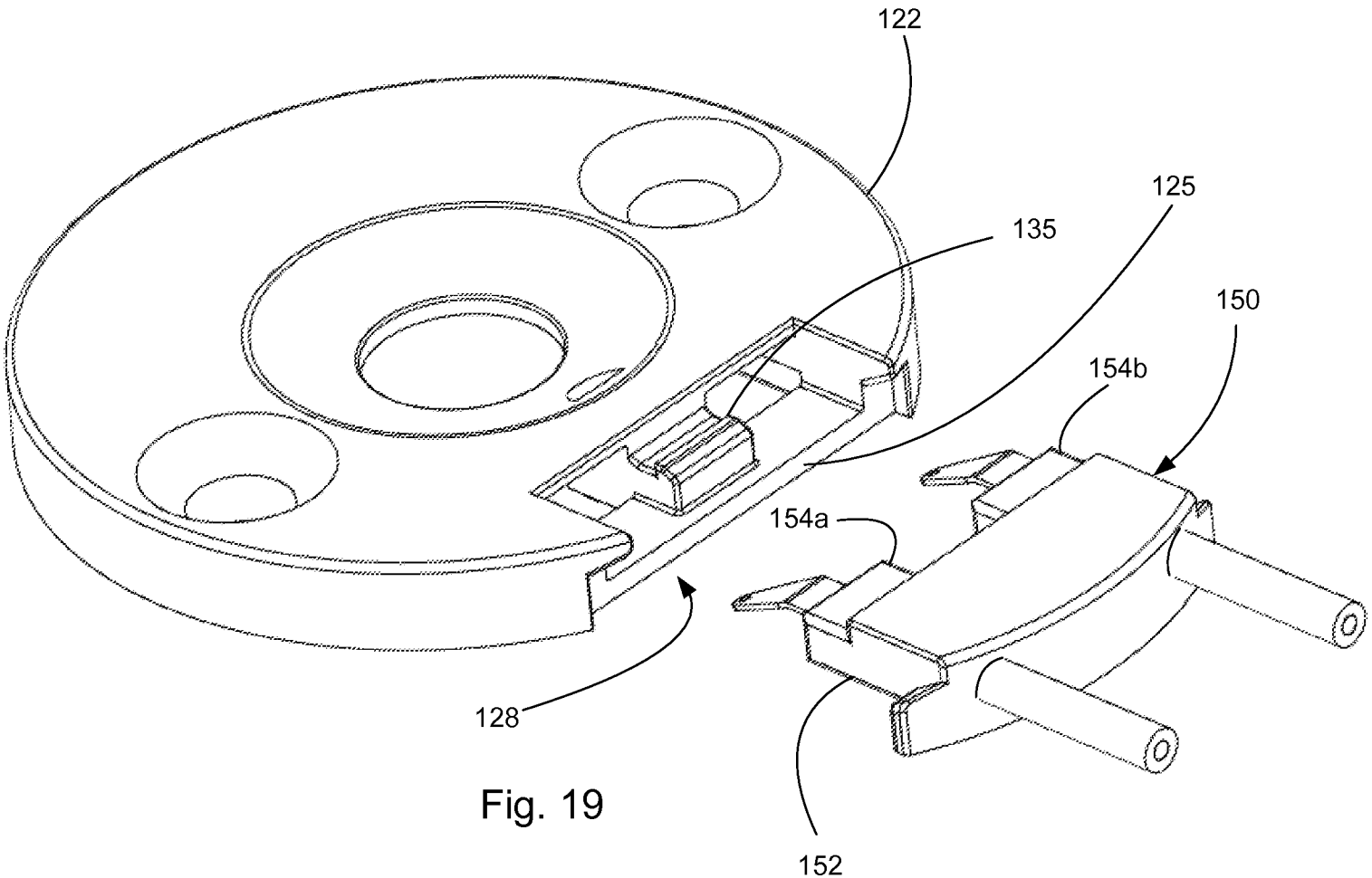
FIG. 19 illustrates a perspective, partially exploded view of the embodiment depicted in FIG. 17.
Figure 20:
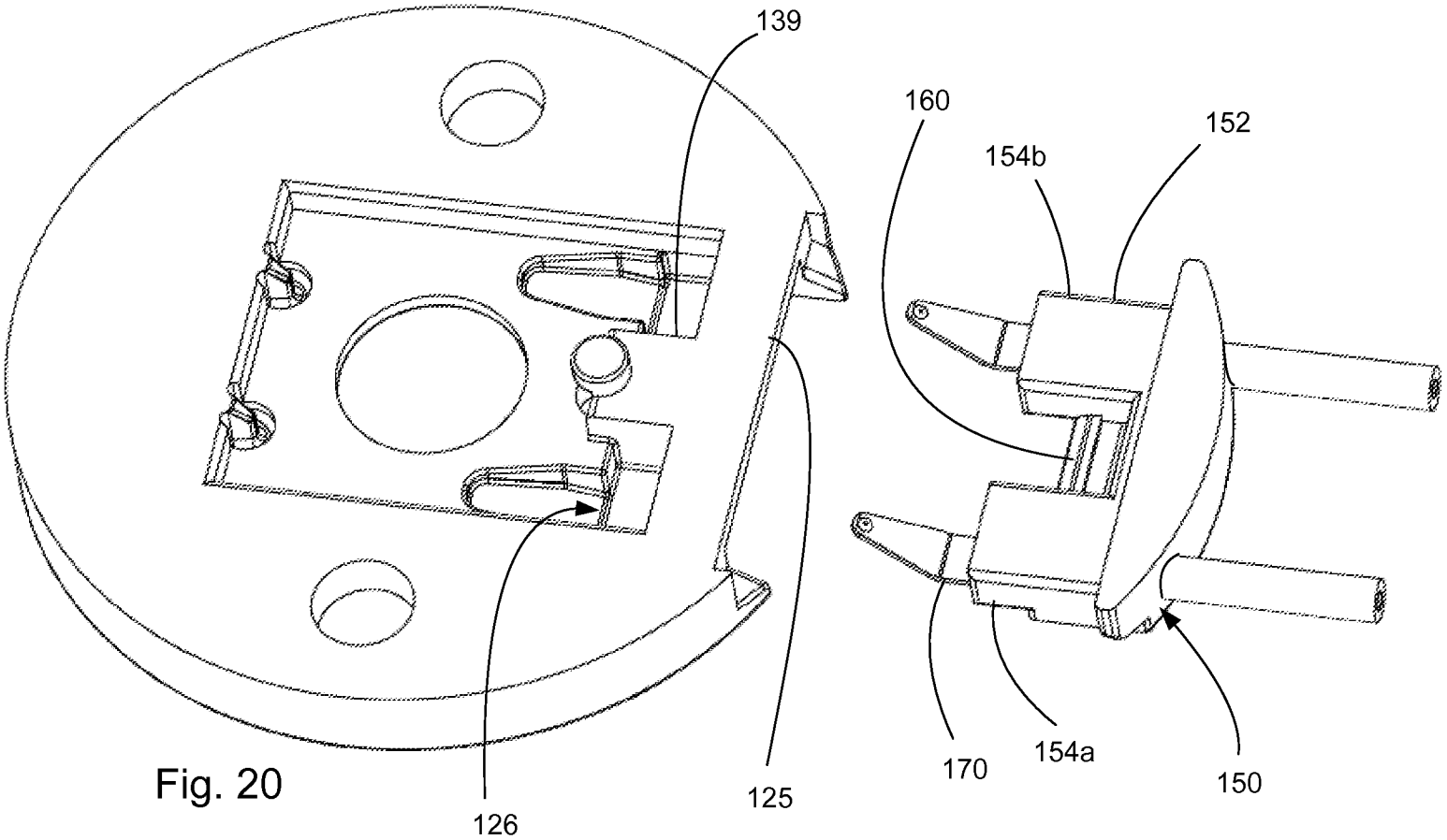
FIG. 20 illustrates another perspective view of the embodiment depicted in FIG. 19.
Figure 21:
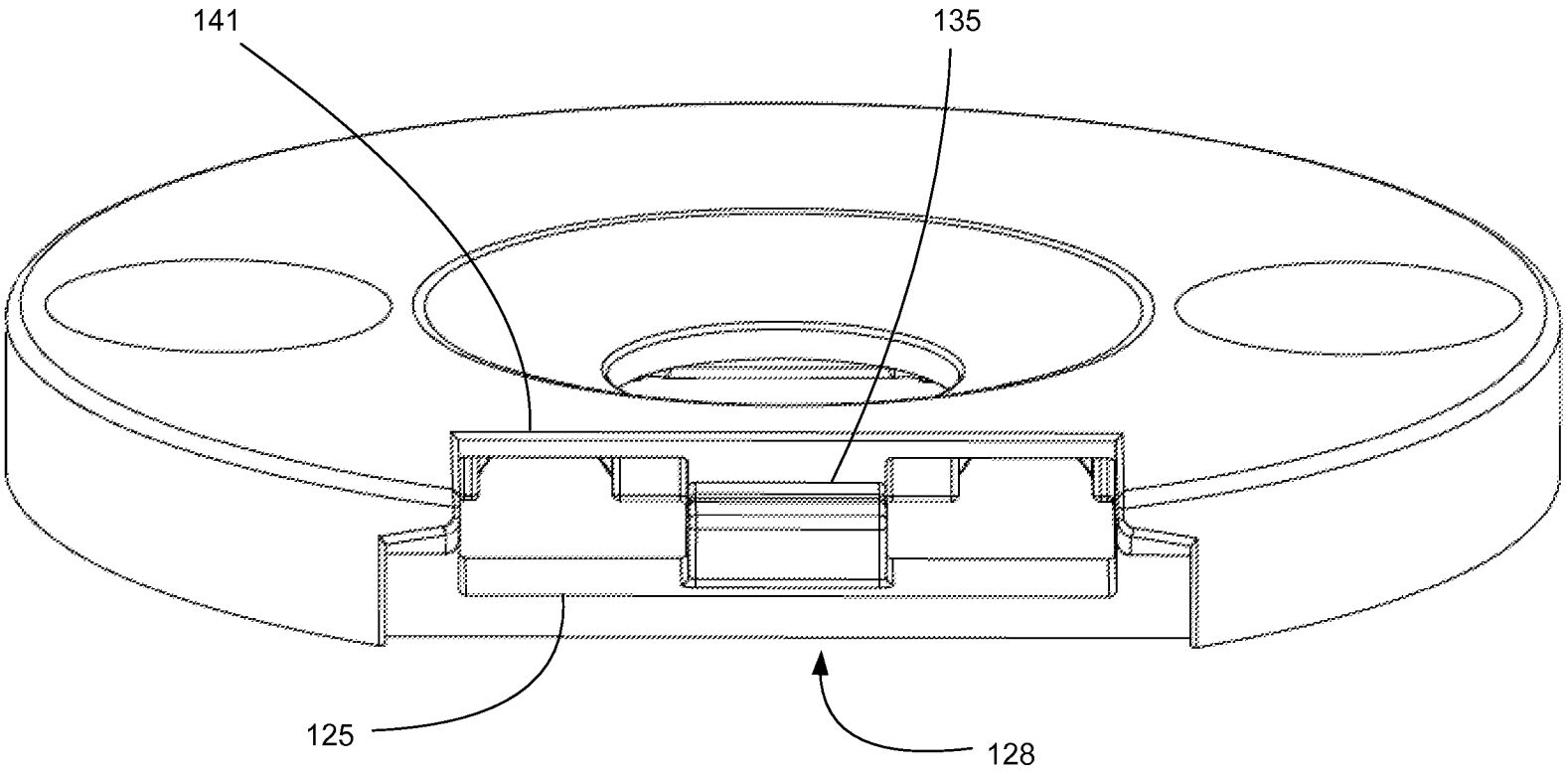
FIG. 21 illustrates a perspective view of an embodiment of a holder.
Figure 22:
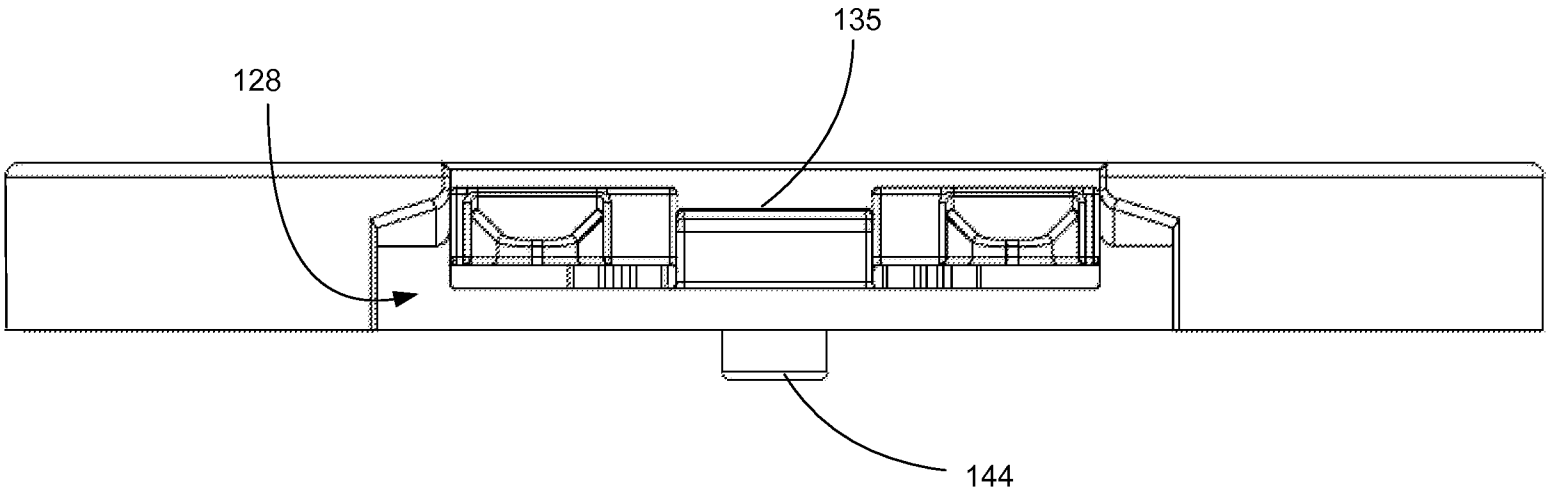
FIG. 22 illustrates an elevated side view of the embodiment depicted in FIG. 21.
Figure 23A:
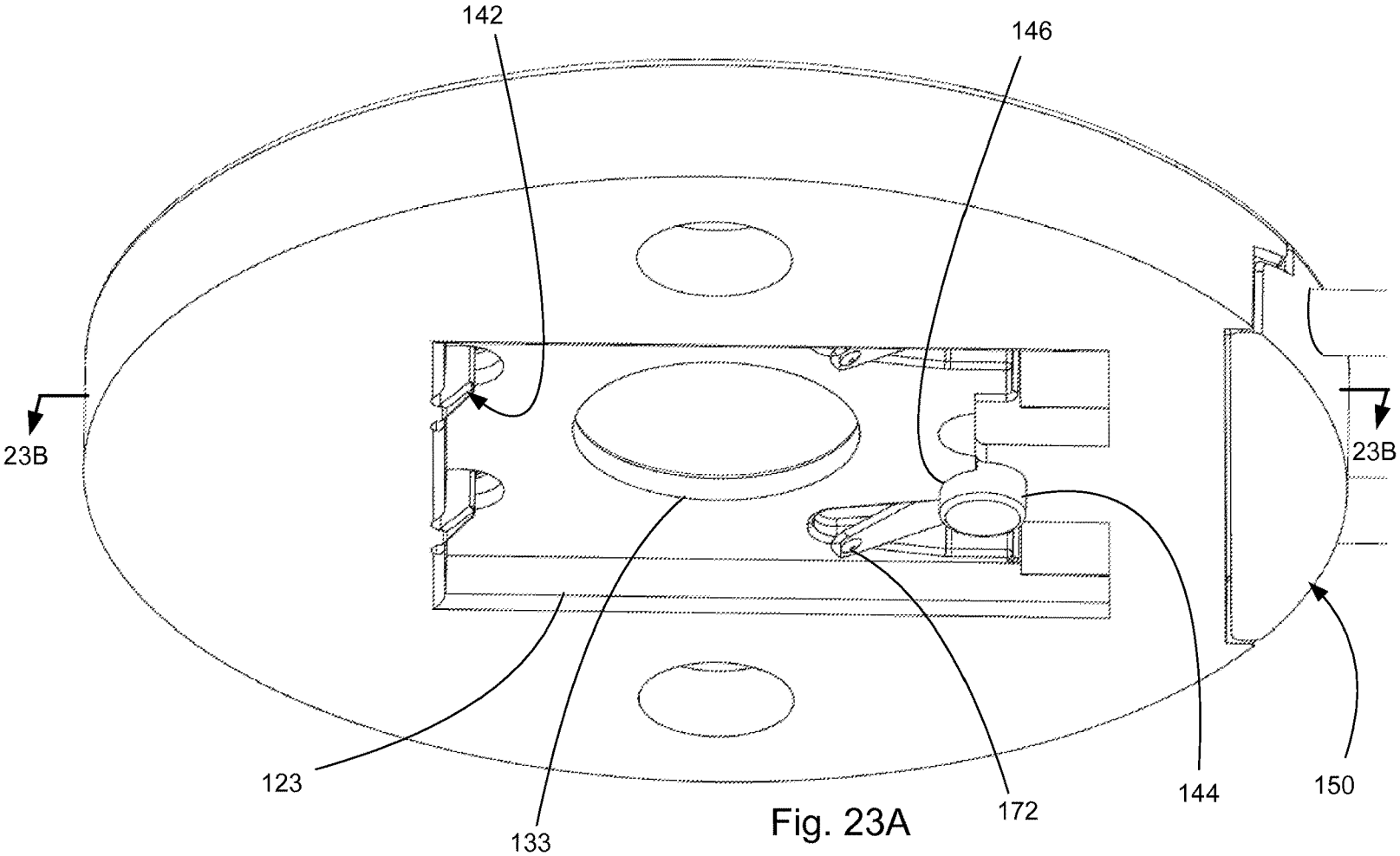
FIG. 23*a* illustrates a perspective view of an embodiment of a holder assembly.
Figure 24A:
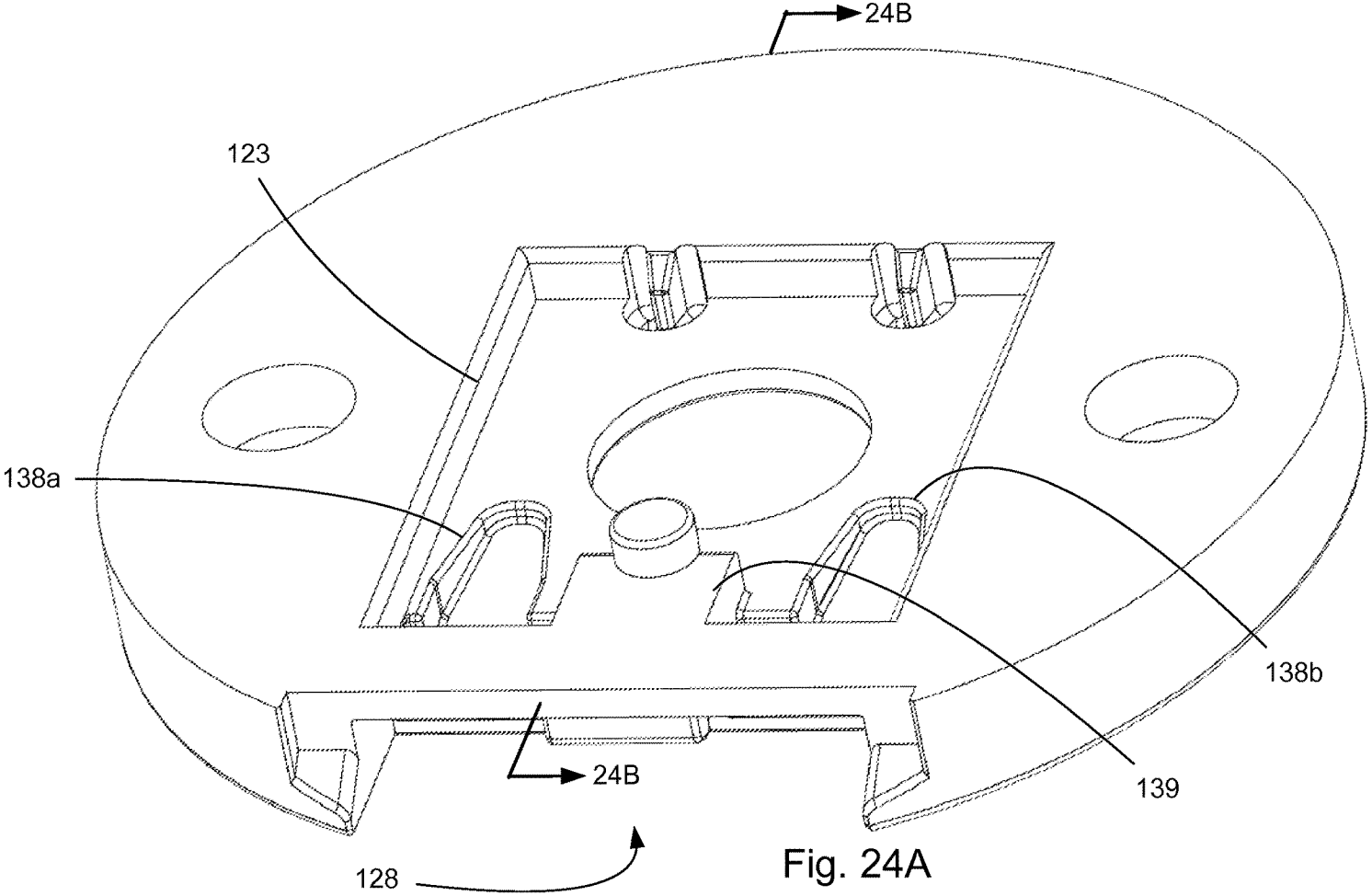
FIG. 24A illustrates a perspective view of an embodiment of a holder.
Figure 23B:
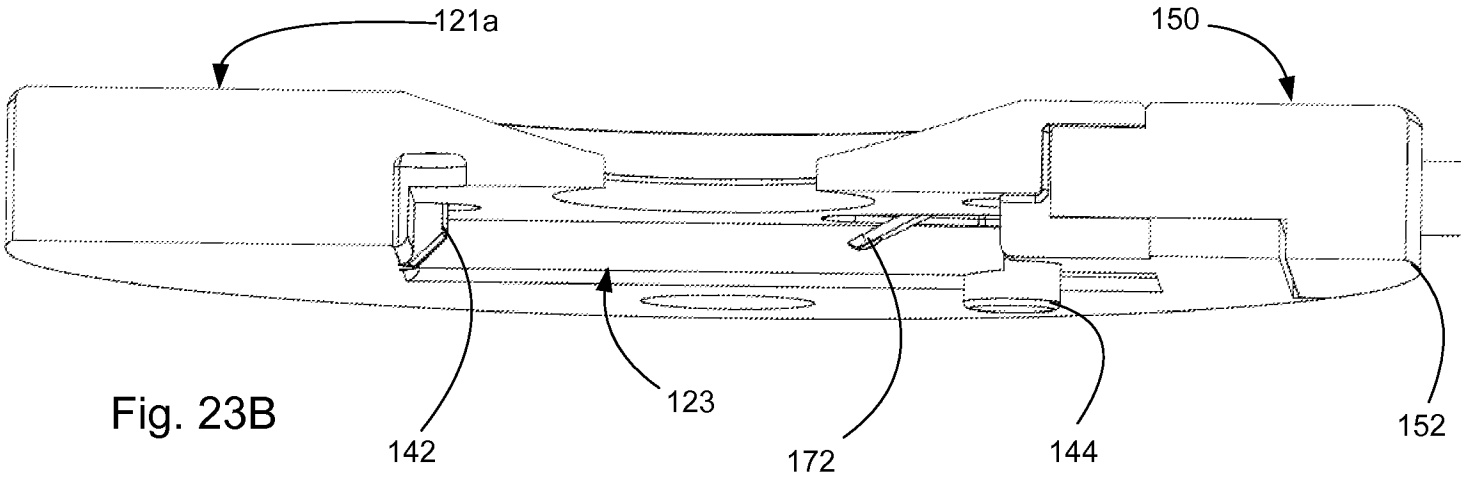
FIG. 23B illustrates a perspective view of a cross-section of the holder assembly depicted in FIG. 23A taken along line –23B-23B.
Figure 24B:
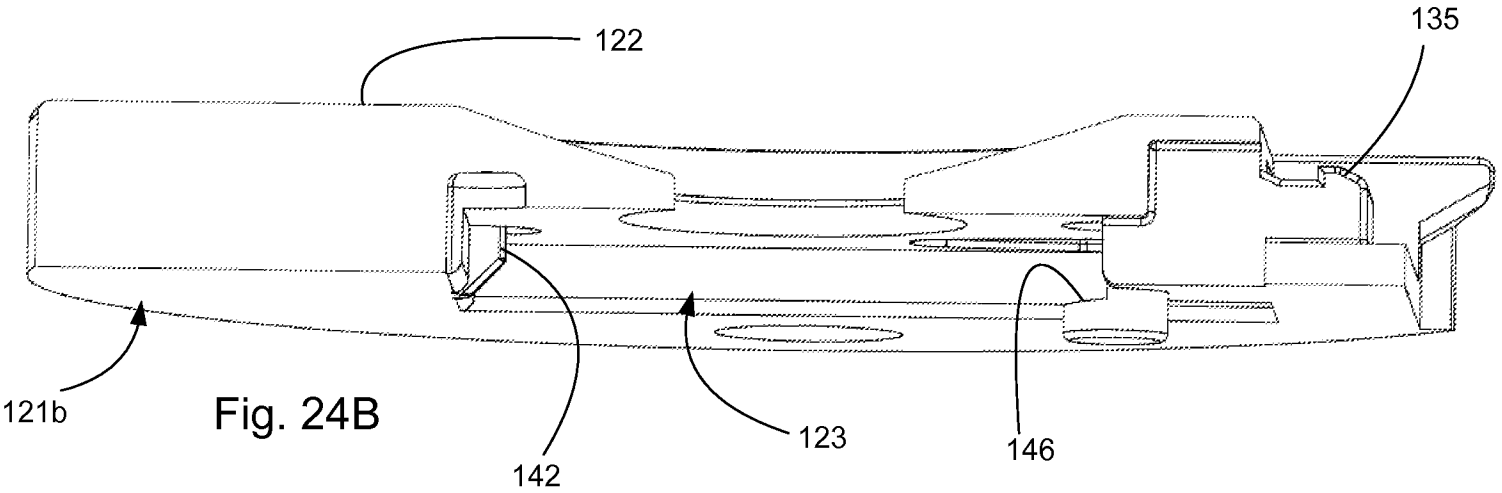
FIG. 24B illustrates a perspective view of a cross-section of the holder depicted in FIG. 24A, taken along line 24B-24B.

FIGS. 17-24B illustrate another embodiment of a holder assembly 110, which, as depicted, includes a holder 120 with a frame 122 that has fastener holes 124 and an aperture 133 that includes an angled surface 134. The holder 120 includes a top surface 121*a* and a bottom surface 121*b* and a socket 128. The holder includes an array recess 123 with crush ribs 142 (while two crush ribs are shown, one or more crush ribs could be used) and a retention block 144 that includes a cutout 146. A terminal slot 138*a*, 138*b* extends into the array recess 123 and a block 139 separates the terminal slots 138*a*, 138*b*, The terminal slots 138*a*, 138*b* provide clearance for the terminals and help ensure the holder 120 has a low profile.

A socket 128 is defined by an upper wall 141 and a shelf 125. The socket 128 is configured to receive an insert 150 and includes a finger 135 that engages a notch 160. The insert 150 includes projections 154*a*, 154*b* that are supported by the shelf 125 and the projections support terminals 170.

It should be noted, just as in the embodiment depicted in FIGS. 1-16, the array recess 123 is in communication with the socket 128 so that terminals 170 can extend from the insert to the array recess 123. The array recess is also in communication with the aperture 133 so that light emitted by a corresponding LED array can pass through the holder 120.

As can be appreciated, the design of the holder assembly 110 is similar to the holder assembly 10 but instead of providing an integrated connecter the insert 150 has conductors 155 (which can be covered with an insulate material) extending from the insert 150. In an embodiment the conductors 155 can be secured to the terminals 170 with a crimp or solder or other suitable connection and then insert-molded in the base 152 so as to provide the insert 150. The insert-molding can also provide strain relief for the connection between the conductors 155 and the terminals 170. Thus, a single housing could receive either the insert with the integrated connector or the insert with the conductors. As can be appreciated, this substantially enhances the flexibility of the design. However, if desired the inserts could also be configured so that they were not interchangeable.

It should be noted that the holder in FIGS. 1-16 has arms 29 that retain the LED array 15 in position. The holder 120 depicted in FIGS. 17-24B uses crush ribs 141 to provide an interference fit to secure an LED array in position. The holder is not so limited, however, and other suitable mechanisms can be used to retain an LED array in position. Naturally, the desired configuration of insert can be used in a holder without limitation with respect to how the holder retains an LED array in position.

It should be noted that the depicted embodiments illustrate two projections. In an alternative embodiment the two projections could be provided as a single projection and thus these features is not intended to be limiting unless otherwise noted.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A LED holder assembly, comprising:

a holder with a frame that includes an array recess configured to receive an LED array and secure it in position, the frame including an aperture and a socket that are both in communication with the array recess; and an insert with a base configured to be mounted in the socket, the insert including a mating pocket and a first terminal supported by the base, the first terminal providing a first contact that extends into the array recess and a second contact that extends into the mating pocket, the first terminal including a first body extending between the first contact and the second contact, and the insert further including a second terminal supported by the base, the second terminal providing a third contact extending into the array recess and a fourth contact extending into the mating pocket, the second terminal including a second body extending between the second and fourth contacts, wherein the insert includes a first projection that is configured, in operation, to be positioned on top of an LED array, the projection having the first terminal extend therefrom.

2. The LED holder assembly of claim 1, the first projection configured such that a distance from the first terminal along a perimeter of the projection to a conductive surface of the LED array provides a predetermined voltage isolation.

3. The LED holder assembly of claim 1, wherein the insert includes a second projection that is configured, in operation, to be positioned on top of the LED array, the projections respectively having the first and second terminals extend therefrom and configured such that a distance from one of the terminals along a perimeter of the projection to a conductive surface of the LED array provides a predetermined voltage isolation.

4. The LED holder assembly of claim 3, wherein the distance is at least 2 mm.

5. The LED holder assembly of claim 1, wherein the frame includes a terminal slot extending into the array recess, the terminal slot aligned with the first contact.

6. A LED holder assembly, comprising:

a frame with an array recess configured to receive an LED array and secure it in position, the frame including a socket;

an insert with a base configured to be mounted in the socket, the insert including a first terminal supported by the base and electrically connected to a first conductor that extends from the insert, the first terminal providing a first contact that extends into the array recess, the first terminal including a first body extending between the first contact and the conductor, and the insert further including a second terminal supported by the base and electrically connected to a second conductor, the second terminal providing a second contact extending into the array recess, the second terminal including a second body extending between the second contact and the second conductor, wherein the insert includes a first projection and a second projection that are configured, in operation, to be positioned on top of an LED array, the projections respectively having the first and second terminals extend therefrom.

7. The LED holder assembly of claim 6, wherein the first and second conductors are covered with an insulative layer.

8. The LED holder assembly of claim 6, wherein the frame includes a first terminal slot extending into the array recess that is aligned with the first contact and further includes a second terminal slot extending into the array recess that is aligned with the second contact.

9. The LED holder assembly of claim 6, wherein the array recess includes at least one crush rib.

10. The LED holder assembly of claim 6, wherein the frame includes a retention block configured, in operation, to support one edge of an LED array.

11. The LED holder assembly of claim 6, the projections configured such that a distance from one of the terminals along a perimeter of the projection to an conductive surface of the LED array provides a predetermined voltage isolation.

* * * * *